US007607245B2

(12) United States Patent
Satake et al.

(10) Patent No.: US 7,607,245 B2
(45) Date of Patent: Oct. 27, 2009

(54) CONSTRUCTION MACHINE

(75) Inventors: Hidetoshi Satake, Ishioka (JP); Yukihiro Tatsuno, Tsukuba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 632 days.

(21) Appl. No.: 10/528,575

(22) PCT Filed: Sep. 26, 2002

(86) PCT No.: PCT/JP02/09965

§ 371 (c)(1),
(2), (4) Date: May 22, 2005

(87) PCT Pub. No.: WO2004/029369

PCT Pub. Date: Apr. 8, 2004

(65) Prior Publication Data

US 2006/0042129 A1 Mar. 2, 2006

(51) Int. Cl.
*G05D 1/02* (2006.01)

(52) U.S. Cl. ..... 37/348; 37/414

(58) Field of Classification Search ..... 37/348, 37/382, 414, 902

See application file for complete search history.

(56) References Cited

U.S. PATENT DOCUMENTS 3,863,988 A * 2/1975 Bartels ..... 299/25
4,316,697 A * 2/1982 Yokoyama ..... 414/694
5,446,979 A * 9/1995 Sugiyama et al. ..... 37/348
5,609,089 A * 3/1997 Leidinger ..... 91/516
5,940,997 A * 8/1999 Toyooka et al. ..... 37/411
5,957,213 A * 9/1999 Loraas et al. ..... 172/2
6,169,948 B1 * 1/2001 Fujishima et al. ..... 701/50
6,449,884 B1 * 9/2002 Watanabe et al. ..... 37/348
6,522,964 B1 * 2/2003 Miki et al. ..... 701/50

FOREIGN PATENT DOCUMENTS

| | | |
|---|---|---|
| JP | A 2001-295675 | 10/2001 |
| JP | A 2001-295681 | 10/2001 |
| JP | A 2002-038534 | 2/2002 |
| JP | A 2002-130003 | 5/2002 |
| JP | A 2002-130004 | 5/2002 |
| WO | WO 02/33239 A1 | 4/2002 |

* cited by examiner

*Primary Examiner*—Thomas B Will
*Assistant Examiner*—Jamie L McGowan
(74) *Attorney, Agent, or Firm*—Oliff & Berridge PLC

(57) ABSTRACT

A construction machine according to the present invention includes a variable displacement hydraulic pump (11, 12) driven by a prime mover (10), a single traveling actuator (5) driven with pressure oil discharged from the hydraulic pump (11), a plurality of work actuators (2*a*, 4*d* to 4*f*) driven with the pressure oil discharged from the hydraulic pump (11, 12), a plurality of control valves (13 to 17) that control flows of the pressure oil from the hydraulic pump (11) to each of the traveling actuator (5) and the plurality of work actuators (2*a*, 4*d* to 4*f*), a detection means (24) for detecting a drive command for the traveling actuator (5), and a flow rate control means (11*a*, 30, 40, 43) for increasing a maximum flow rate of the hydraulic pump (11) when the drive command for the traveling actuator (5) is detected with the detection means (24).

8 Claims, 13 Drawing Sheets

CONSTRUCTION MACHINE

TECHNICAL FIELD

The present invention relates to a construction machine at which a plurality of control valves are mounted to control hydraulic actuators.

BACKGROUND ART

In general, a crawler mounted construction machine having a pair of crawlers includes hydraulic equipments such as a pair of traveling hydraulic motor for driving each of the crawlers, a pair of hydraulic pumps for supplying driving pressure to each of the hydraulic motors, and a pair of control valves for controlling the flow of pressure oil from each hydraulic pump to each hydraulic motor.

It is desired that control valve sections installed in such a crawler mounted construction machine, for instance, a crawler mounted hydraulic excavator can also be used in a wheeled construction machine, such as a wheeled hydraulic excavator from a viewpoint of cost reduction. When the control valve sections of the crawler mounted hydraulic excavator are to be used in the wheeled hydraulic excavator, the pressure oil from each of the hydraulic pumps is made to flow together in the downstream of the control valve, and then this mixed oil is supplied to the hydraulic motor for wheels. As a result, the hydraulic motor rotates at high-speed to achieve the high-speed travel of the wheeled hydraulic excavator.

However, since confluence of the pressure oil is required due to the use of a pair of control valves with the wheeled hydraulic excavator which is generally equipped with only one traveling hydraulic motor, the circuit structure of the traveling system becomes complex.

Moreover, the number of actuators of the wheeled hydraulic excavator is likely to increase compared with the crawler mounted hydraulic excavator because various work attachments can be installed in the wheeled hydraulic excavator. However, increase in the number of actuators requires additional control valves, and thus the control valve sections of the crawler mounted hydraulic excavator cannot be used without any modifications, thereby causing the cost to increase.

DISCLOSURE OF THE INVENTION

An object of the present invention is to provide a construction machine capable of preventing a circuit structure of a traveling system being complicated and of using control valve sections in an effective manner.

A construction machine according to the present invention includes a variable displacement hydraulic pump driven by a prime mover, a single traveling actuator driven with pressure oil discharged from the hydraulic pump, a plurality of work actuators driven with the pressure oil discharged from the hydraulic pump, a plurality of control valves that control flows of the pressure oil from the hydraulic pump to each of the traveling actuator and the plurality of work actuators, a detection means for detecting a drive command for the traveling actuator, and a flow rate control means for increasing a maximum flow rate of the hydraulic pump when the drive command for the traveling actuator is detected with the detection means.

In this manner, the traveling motor can be driven at high speed with the oil discharged from the single main pump. Accordingly, it is not necessary to form a traveling circuit of a wheeled construction machine to be a flow combining circuit, and as a result, control valve sections can be used effectively.

The present invention is ideal in an application in a wheeled hydraulic excavator. In this case, the traveling actuator, a revolving actuator, a boom actuator, an arm actuator, and a work tool actuator may be provided together with the control valves that control the flow of the pressure oil to each of the actuators. In addition, a spare control valve may be provided. In this manner, the control valve sections for the wheeled hydraulic excavator can be utilized in a crawler mounted hydraulic excavator.

It is desirable to increase the pump flow rate by adjusting a maximum displacement angle of the hydraulic pump, or by adjusting the maximum displacement angle of the hydraulic pump and a rotation speed of the prime mover. Only the maximum displacement angle of the hydraulic pump that supplies the pressure oil to the traveling motor may be adjusted.

BEST MODE FOR CARRYING OUT THE INVENTION

An embodiment achieved by adopting the present invention in a wheeled hydraulic excavator is explained in reference to FIGS. 1 through 13.

Figure 1:
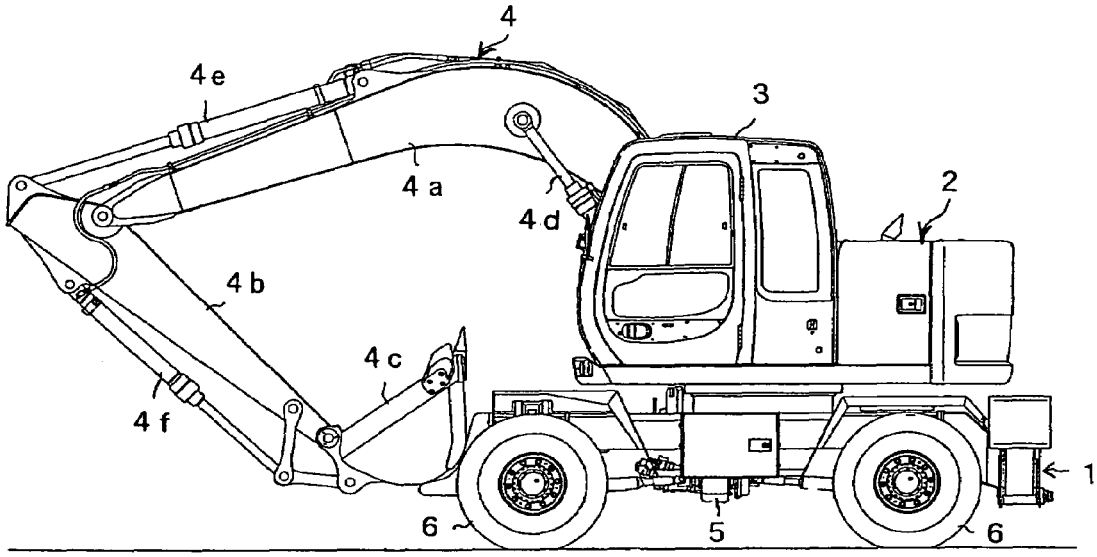
FIG. 1 is an external view of a wheeled hydraulic excavator in which the present invention is adopted.

As shown in FIG. 1, the wheeled hydraulic excavator includes an undercarriage 1 and a revolving superstructure 2 rotatably mounted atop the undercarriage 1. An operator's cab 3 and a work front attachment 4 constituted with a boom 4*a*, an arm 4*b* and a bucket 4*c* are provided at the revolving superstructure 2. The boom 4*a* is raised/lowered as a boom cylinder 4*d* is driven, the arm 4*b* is raised/lowered as an arm cylinder 4*e* is driven and the bucket 4*c* is engaged in a dig/dump operation as a bucket cylinder 4*f* is driven. A traveling motor 5, which is hydraulically driven, is provided at the undercarriage 1, and the rotation of the traveling motor 5 is transmitted to wheels 6 (tires) via a drive shaft and an axle.

Figure 2:
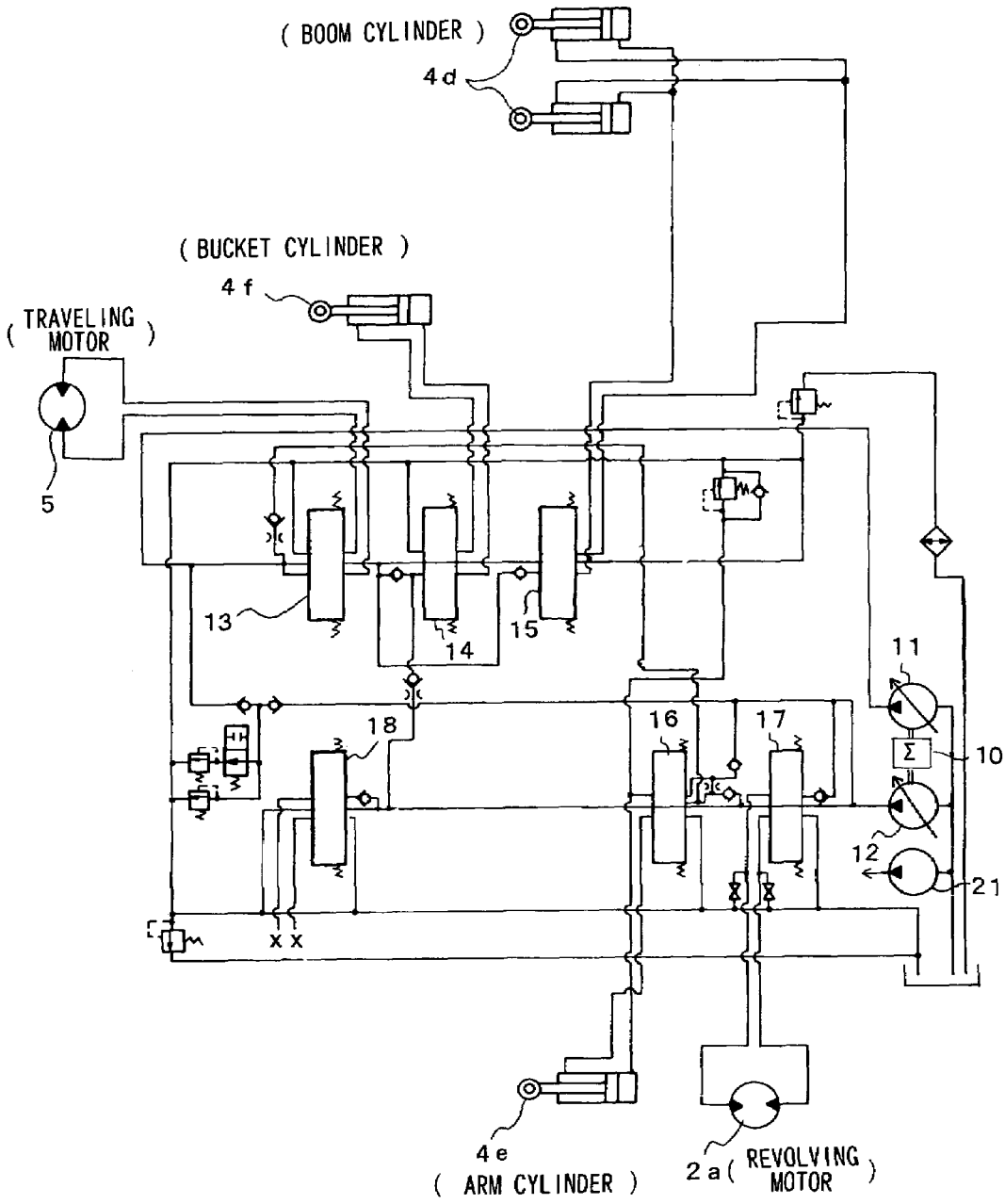
FIG. 2 is a circuit diagram of a hydraulic circuit in the wheeled hydraulic excavator in FIG. 1.

FIG. 2 is a circuit diagram of a hydraulic circuit for driving actuators mounted at the wheeled hydraulic excavator according to the present invention. This hydraulic circuit includes: a pair of main pumps 11 and 12 driven with an engine 10; three control valves 13 to 15 arranged in series with the main pump 11; three control valves 16 to 18 arranged in series with the main pump 12; the traveling motor 5 driven with the pressure oil controlled by the control valve 13; the bucket cylinder 4*f* driven with the pressure oil controlled by the control valve 14; the boom cylinder 4*d* driven with the pressure oil controlled by the control valve 15; the arm cylinder 4*e* driven with the pressure oil controlled by the control valve 16; and a revolving motor 2*a* driven with the pressure oil controlled by the control valve 17. It is to be noted that the control valve 18 is a spare valve and it is not always necessary.

In this embodiment, the oil delivered from the main pump 11 is supplied to the traveling motor 5 with its amount being increased as described later instead of supplying to the traveling motor 5 the confluence pressure oil from the main pumps 11 and 12. In this manner, one control valve for traveling can be saved.

A pilot pump 21 supplies the pilot pressure to the control valve 13 for traveling and the control valves 14 to 17 for work.

Figure 3:
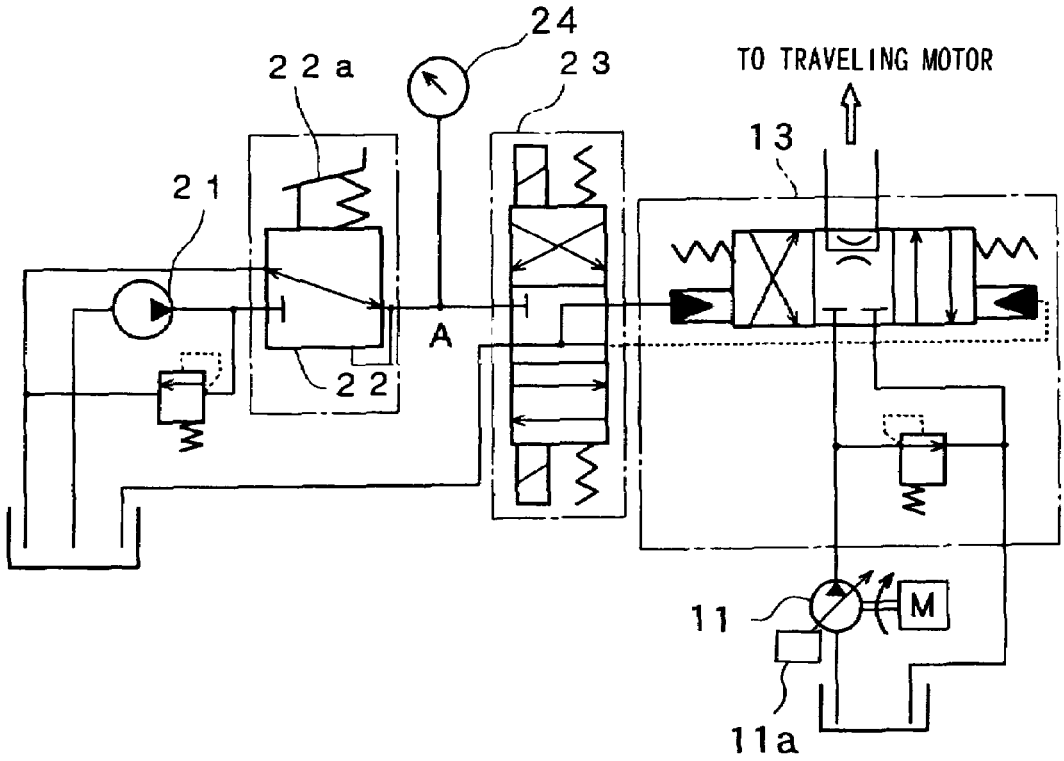
FIG. 3 is a circuit diagram of a traveling pilot hydraulic circuit of the wheeled hydraulic excavator in accordance with an embodiment of the present invention.

FIG. 3 is a circuit diagram of a traveling pilot hydraulic circuit in the wheeled hydraulic excavator. This hydraulic circuit includes the pilot pump 21, a pilot valve 22 operated through a travel pedal 22*a*, and a forward/backward switching valve 23 that is switched to a forward position, a backward position or a neutral position in response to an operation of a forward/backward selector switch (not shown) As the forward/backward switching valve 23 is set to the forward position or the backward position through a switch operation and then the travel pedal 22*a* is operated, a pilot pressure originating from the pilot pump 21 is applied to the control valve 13. In response, the pressure oil from the main pump 11 is supplied to the traveling motor 5 via the control valve 13 and the vehicle travels forward or backward with the rotation of the traveling motor 5. A pressure sensor 24 is connected to the pilot valve 22 so as to detect a pressure Pt as a traveling command.

Figure 4:
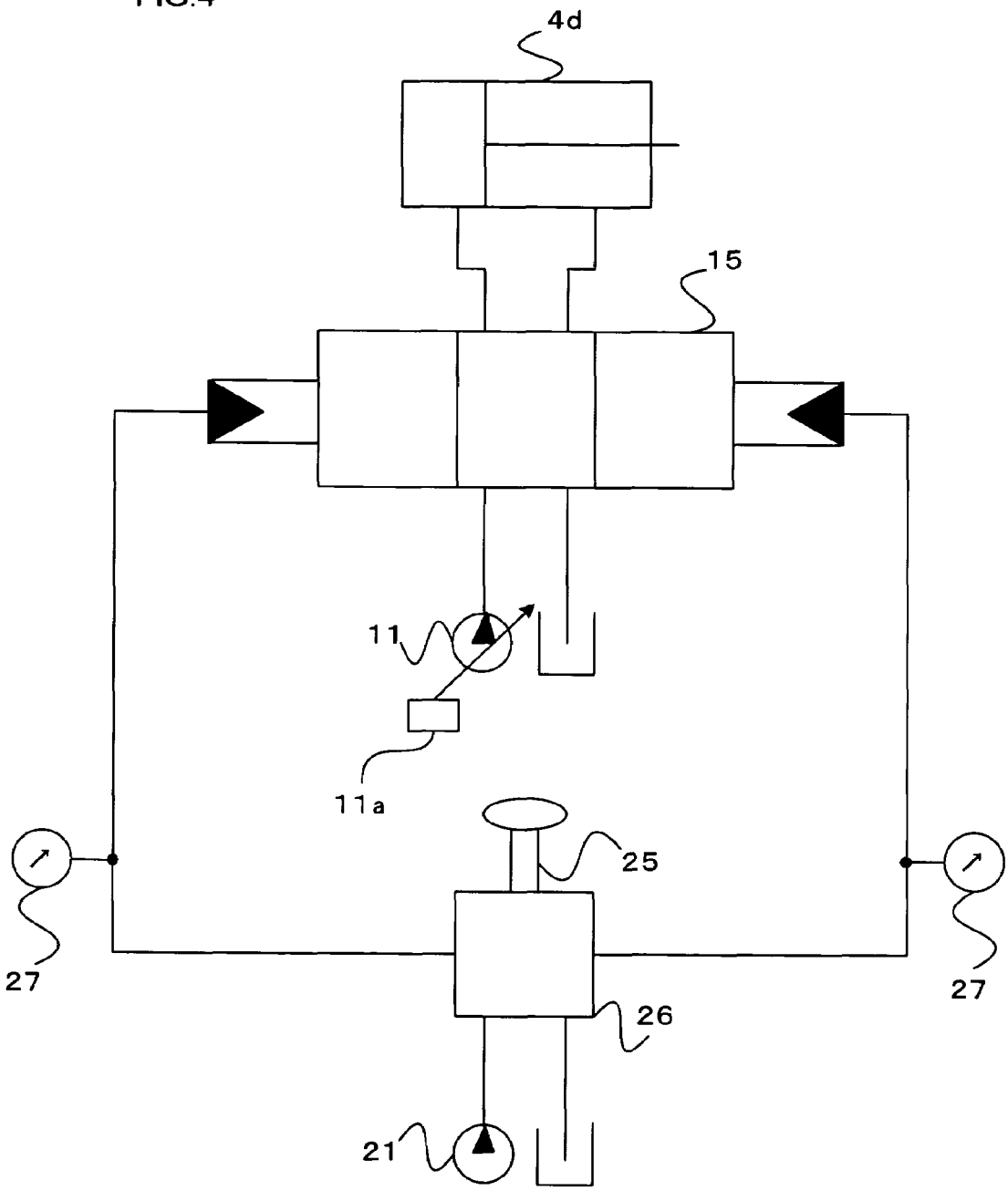
FIG. 4 is a circuit diagram of a work pilot hydraulic circuit of the wheeled hydraulic excavator in accordance with the embodiment of the present invention.

A boom pilot circuit is shown in FIG. 4 as one example of the work pilot circuits. This hydraulic circuit includes the pilot pump 21 and a pilot valve 26 operated via an operating lever 25. It is to be noted that although not shown, other work pilot circuits are similar to that shown in FIG. 4. In response to an operation of the operating lever 25, the pilot valve 26 is driven in correspondence to the extent to which the operating lever 25 has been operated and a pilot pressure from the pilot pump 21 is applied to the control valve 15. As a result, the pressure oil from the main pump 11 is guided to the boom cylinder 4*d* via the control valve 15 and, as the boom cylinder 4*d* extends/contracts, the boom 4*a* is raised/lowered. A pressure sensor 27 is connected to the pilot valve 26 so as to detect a pilot pressure as a work command.

Figure 5:
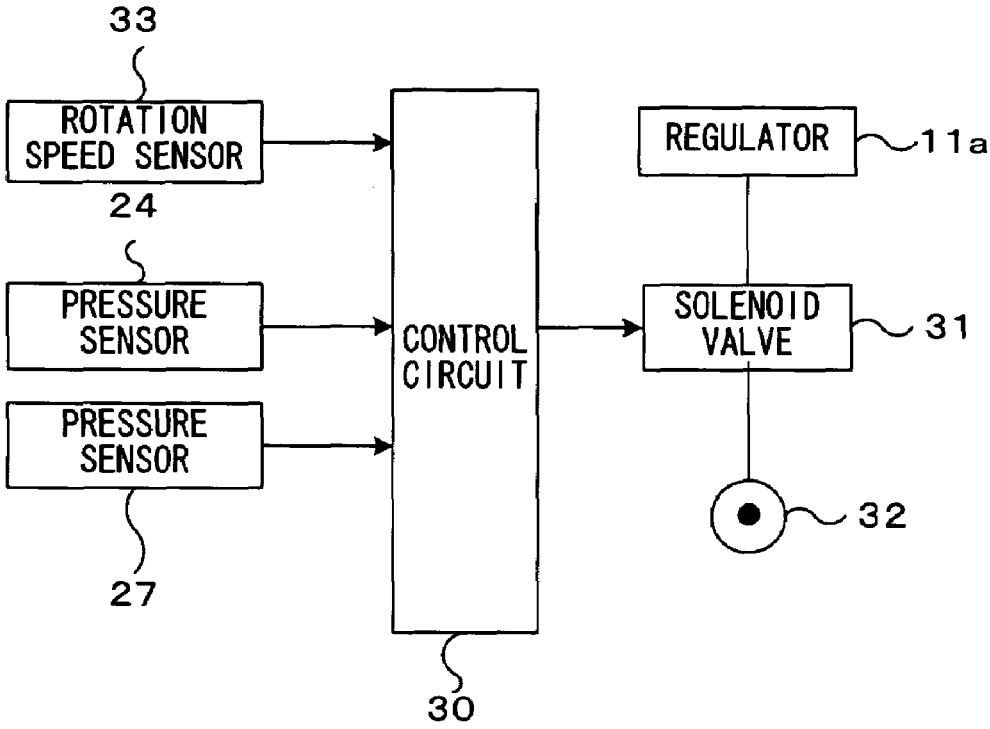
FIG. 5 is a block diagram of a control circuit that controls a displacement angle of a hydraulic pump shown in FIG. 2.

The main pump 11 shown in FIGS. 3 and 4 is a variable displacement pump and the degree of swash angle or displacement angle is adjusted by a regulator 11*a*. FIG. 5 is a block diagram of a control circuit that controls the pump displacement angle. As shown in the drawing, the regulator 11*a* is connected to a hydraulic source 32 via a solenoid valve 31, and a pilot pressure corresponding to an operation of the solenoid valve 31 is applied to the regulator 11*a*. A control circuit 30 constituted with, for instance a CPU and the like, is connected with a rotation speed sensor 33 that detects a rotation speed of the traveling motor 5 and the pressure sensors 24 and 27. The control circuit 30 for controlling the displacement angle executes the following arithmetic operations, and outputs a low signal or a high signal to the solenoid valve 31. As a result, a maximum displacement angle of the main pump 11 is regulated to either a value qp1 (for increase) or a value qp2 (for normal).

Figure 6:
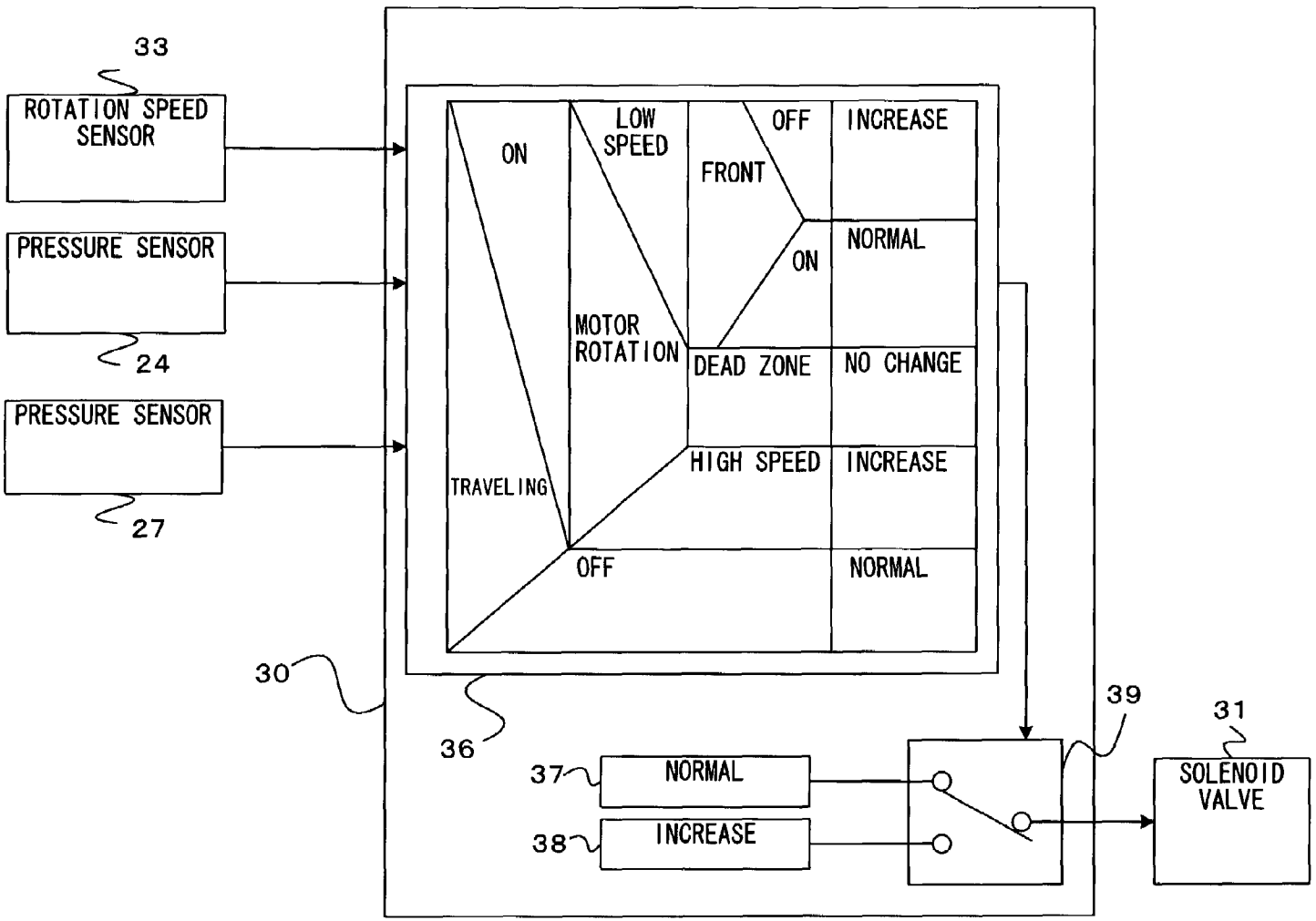
FIG. 6 shows in detail a control circuit in FIG. 5.

FIG. 6 is a conceptual diagram illustrating in detail the displacement angle control circuit 30. Signals from the rotation speed sensor 33 and the pressure sensors 24 and 27 are input to a determination unit 36. The determination unit 36 makes a decision based on the signal from the rotation speed sensor 33 whether the motor rotation speed is equal to or greater than a predetermined value N1 for high-speed, less than a predetermined value N2 for low-speed which is smaller than the value N1, or in a dead zone greater than or equal to the predetermined value N2 and less than the predetermined value N1. It is also determined as to whether or not the front attachment 4 is being operated based on the signal from the pressure sensor 27 and as to whether or not the travel pedal 22*a* is being depressed based on the signal from the pressure sensor 24.

When the operation for traveling is detected, the motor rotation speed is low, and the front attachment is being operated, the displacement angle is decided to be normal, whereas when the front attachment is not being operated, the displacement angle is decided to increase. When the operation for traveling is detected and the motor rotation speed is high, the displacement angle is decided to increase regardless of the operation of the front attachment, whereas when the operation for traveling is not detected, the displacement angle is decided to be normal regardless of the front attachment operation. When the operation for traveling is detected and the motor rotation speed falls in the dead zone, it is decided that the displacement angle is not to be changed.

The displacement angle qp2 is set in advance in a set unit 37, and the displacement angle qp1 is set in advance in a set unit 38. The displacement angles qp1 and qp2 satisfy the following relationship; qp1>qp2. A selection unit 39 selects either the displacement angle qp1 or qp2 according to the decision of the determination unit 36. That is, the displacement angle qp1 is selected when the determination unit 36 has made a decision to increase the displacement angle, whereas the displacement angle qp2 is selected when the displacement angle is decided to be normal. When the displacement angle is decided not to be changed, either the displacement angle qp1 or qp2 which is currently set is selected again. Upon selection of the displacement angle qp1, the high signal is output to the solenoid valve 31 so as to adjust the maximum displacement angle of the pump to the value qp1. If the displacement angle qp2 is selected, the low signal is output to the solenoid valve 31 so as to adjust the maximum displacement angle of the pump to the value qp2.

Figure 7:
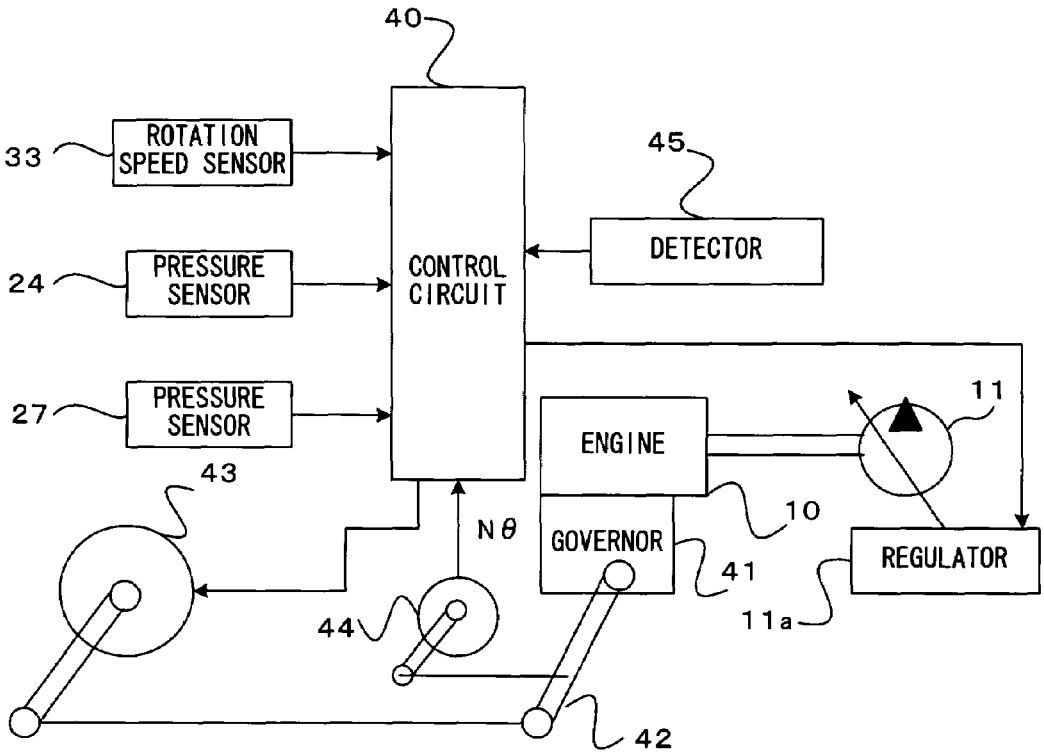
FIG. 7 is a block diagram of a control circuit that controls the rotation speed of an engine shown in FIG. 2.

A pump flow rate changes according to the engine rotation speed. FIG. 7 is a block diagram of a control circuit that controls the rotation speed of the engine. A governor lever 41 of the engine 10 is connected to a pulse motor 43 via a link mechanism 42 and the engine rotation speed is adjusted with the rotation of the pulse motor 43. Namely, the engine rotation speed increases as the pulse motor 43 rotates forward, and the engine rotation speed decreases with a reverse rotation of the pulse motor 43. A potentiometer 44 is connected to the governor lever 41 via the link mechanism 42, and the governor lever angle corresponding to the rotation speed of the engine 10, which is detected with the potentiometer 44, is input to the control circuit 40 as an engine control rotation speed Nθ.

The control circuit 40 is connected with the rotation speed sensor 33, the pressure sensors 24 and 27, and a detector 45 that detects the extent to which an operating member (e.g., a fuel lever) for issuing a rotation speed command (not shown)

is operated. The rotation speed control circuit 40 executes the following arithmetic operation and outputs a control signal to the pulse motor 43.

Figure 8:
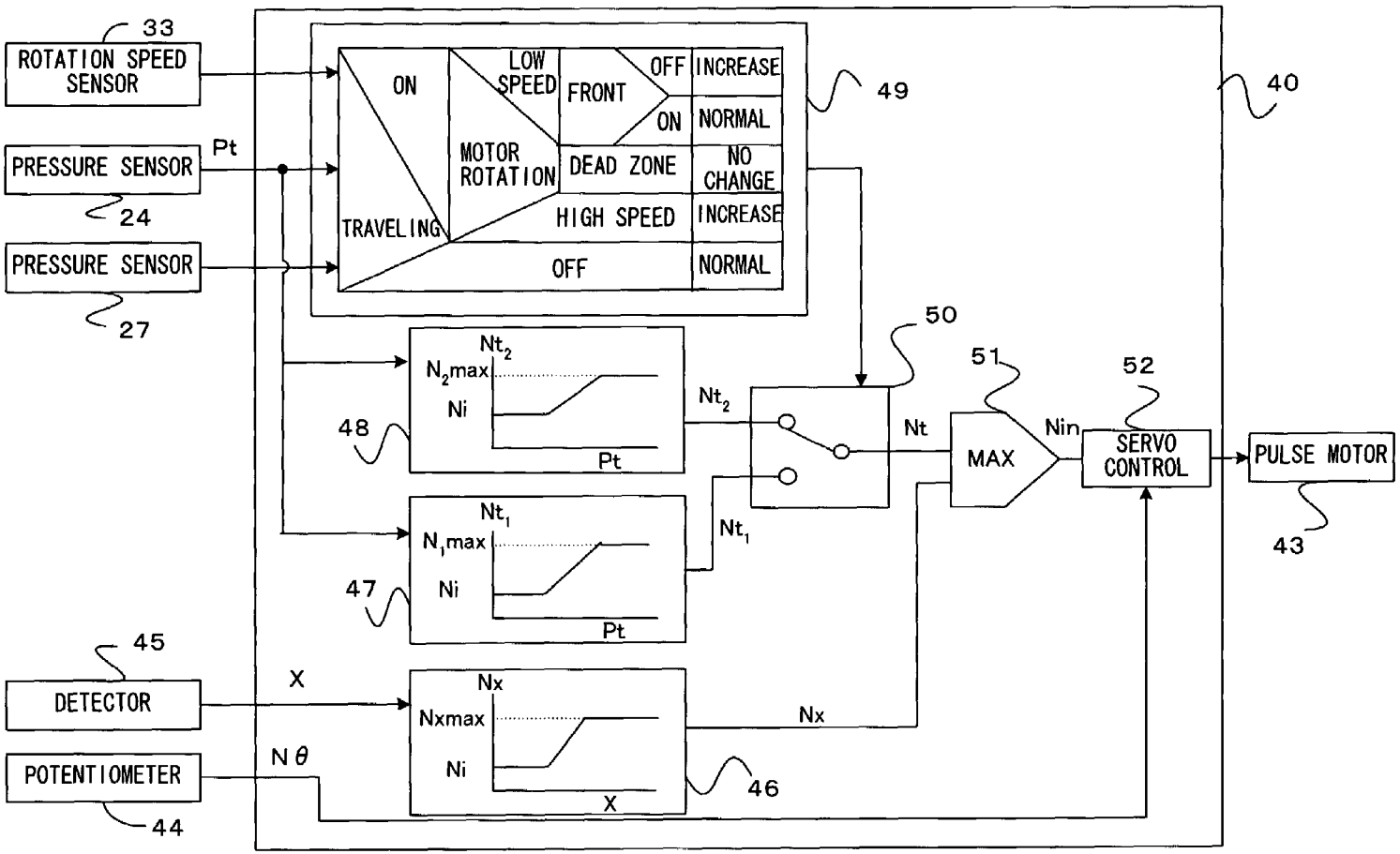
FIG. 8 shows in detail a control circuit in FIG. 7.

FIG. 8 is a conceptual diagram illustrating in detail the rotation speed control circuit 40. The relationships between the detection value Pt provided by the pressure sensor 24 and each of the target rotation speeds Nt1 and Nt2 are stored in memory in advance at rotation speed calculation units 47 and 48 respectively as shown in the figure, and the target rotation speeds Nt1 and Nt2 matching the extent to which the travel pedal 22*a* is operated are individually calculated based upon the characteristics of these relationships. It is to be noted that the characteristics stored in memory at the rotation speed calculation unit 47 are the characteristics suited for traveling, whereas the characteristics stored in memory at the rotation speed calculation unit 48 are the characteristics suited for work performed by using the work attachment 4. These characteristics indicate linear increases in the target rotation speeds Nt1 and Nt2 from the idling rotation speed Ni as the extent of pedal operation increases. The target rotation speed Nt1 increases in a steeper slope compared to the target rotation speed Nt2, and a maximum value Nt1max of the target rotation speed Nt1 is greater than a maximum value Nt2max of the target rotation speed Nt2.

As shown in the figure, the relationship between the detection value X provided by the detector 45 and a target rotation speed Nx is stored in memory in advance at a rotation speed calculation unit 46, and the target rotation speed Nx corresponding to the extent to which the fuel lever is operated is calculated based upon the characteristics of the relationship. It is to be noted that a maximum value Nxmax of the target rotation speed Nx is set equal to the maximum value N2max at the rotation speed calculation unit 48.

A determination unit 49 operates in a similar manner to the determination unit 36 described above. That is, it decides the rotation speed to be normal when the operation for traveling is detected, the motor rotation speed is low and the front attachment is being operated, whereas it decides the rotation speed to increase when the front attachment is not operated. The rotation speed is decided to be increased when the operation for traveling is detected and the motor rotation speed is high regardless of the front attachment operation, whereas the rotation speed is decided to be normal when the operation of traveling is not detected regardless of the front attachment operation. It is decided that the rotation speed is not to be changed when the operation for traveling is detected and the motor rotation speed falls in the dead zone.

The selection unit 50 selects either the target rotation speed Nt1 or Nt2 based on the decision of the determination unit 49. That is, the target rotation speed Nt1 is selected when the determination unit 49 have made a decision to increase the rotation speed, whereas the target rotation speed Nt2 is selected when the rotation speed is decided to be normal. When the rotation speed is decided not to be changed, either the target rotation speed Nt1 or Nt2 which is currently set is selected again.

A selection unit 51 compares the target rotation speed Nt1 or Nt2 selected by the selection unit 50 with the target rotation speed Nx calculated at the rotation speed calculation unit 46 and selects the larger value. A servo control unit 52 compares the selected rotation speed (the rotation speed command value Nin) with the control rotation speed Nθ corresponding to the displacement quantity of the governor lever 41 detected with the potentiometer 44. Then, it controls the pulse motor 43 through the procedure shown in FIG. 9 so as to match the two values.

Figure 9:
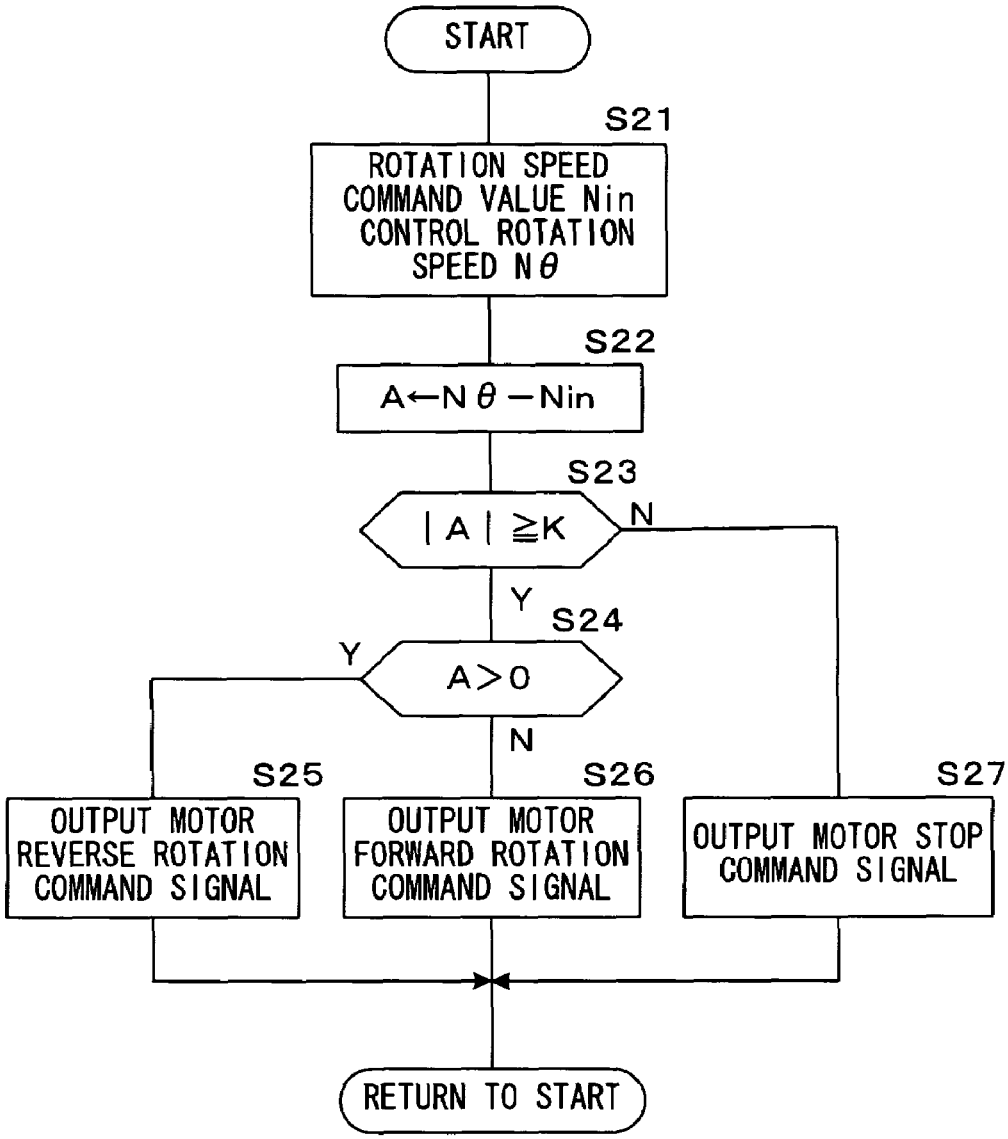
FIG. 9 presents a flowchart of the procedure of controlling an engine rotation speed.

First, the rotation speed command value Nin and the control rotation speed Nθ are individually read in step S21 in FIG. 9. Then, in step S22, the results of subtracting Nin from Nθ are stored as a rotation speed difference A in memory, and in step S23, a decision is made as to whether or not $|A| \geqq K$ is true with regard to the rotation speed difference A and a predetermined reference rotation speed difference K. If an affirmative decision is made, the operation proceeds to step S24 to decide whether or not the rotation speed difference A is greater than 0. If A>0, the control rotation speed Nθ is greater than the rotation speed command value Nin, i.e., the control rotation speed is higher than the target rotation speed and, accordingly, a signal constituting a command for a motor reverse rotation is output to the pulse motor 43 in step S25 in order to lower the engine rotation speed. In response, the pulse motor 43 rotates in the reverse direction, thereby lowering the engine rotation speed.

If, on the other hand, $A \leqq 0$, the control rotation speed Nθ is lower than the rotation speed command value Nin, i.e., the control rotation speed is lower than the target rotation speed and, accordingly, a signal constituting a command for a motor forward rotation is output in step S26 in order to raise the engine rotation speed. In response, the pulse motor 43 rotates forward, thereby raising the engine rotation speed. If a negative decision is made in step S23, the operation proceeds to step S27 to output a motor stop signal and, as a result, the engine rotation speed is sustained at a constant level. Once the processing in one of steps S25 through S27 is executed, the operation returns to the start point.

Next, the operation that characterizes the hydraulic control system of the embodiment is explained.

When the vehicle is only to travel, the fuel lever for instructing the rotation speed, for instance, is set to the idling position, the operating lever 25 is set to the neutral position and the forward/backward selector switch is set to the forward position or the backward position. As the travel pedal 22*a* is depressed to its maximum extent in this state, the control valve 13 is switched with the pilot pressure applied thereto and the traveling motor 5 is caused to revolve by the pressure oil from the main pump 11.

Through the arithmetic operation executed in the displacement angle control circuit 30, the displacement angle qp1 is selected at the selection unit 39 and the high signal is output to the solenoid valve 31 so as to adjust the pump maximum displacement angle to the displacement angle qp1 which is greater than the value normally set. In addition, through arithmetic operation executed in the rotation speed control circuit 40, the target rotation speed Nt1max is selected at the selection units 50 and 51 as the rotation speed command value Nin, and a control signal is output to the pulse motor 43 by the servo control so as to adjust the engine rotation speed to the rotation speed Nt1 which is greater than the value normally set.

The flow rate of the main pump 11 increases by increasing the maximum displacement angle of the pump and the engine rotation speed when traveling as described above. The pump maximum displacement angle qp1 and the engine rotation speed Nt1max are set so that an amount by which the flow rate increases becomes equivalent to a flow rate necessary for ensuring the travel performance, e.g., a flow rate of the main pump 12. As a result, the pressure oil enough to cause the wheeled hydraulic excavator to travel at high speed is supplied to the traveling motor 5 from the single main pump 11. Since the slope of increase in the target rotation speed Nt1 set in the target rotation speed set unit 47 is steep, the, engine rotation speed increases immediately in response to the operation of the travel pedal 22*a* and the excellent acceleration can be achieved.

When the vehicle is to travel while operating the front attachment 4, the pump maximum displacement angle is adjusted to the value qp1 if the rotation speed of the traveling motor 5 is equal to or greater than the predetermined value N2 (or equal to or greater than the value N1 according to circumstances) as described above, and accordingly the engine rotation speed is adjusted to the target rotation speed Nt1. On the other hand, the selection unit 39 selects the displacement angle qp2 and the selection units 50 and 51 each select the target rotation speed Nt2 as the rotation speed command value Nin if the rotation speed of the traveling motor 5 is less than the predetermined value N1 (or less than the value N2 according to circumstances). As a result, the pump maximum displacement angle is regulated to the value qp2 which is smaller than the value qp1 and the engine rotation speed is adjusted to the value Nt2 which is smaller than the value Nt1.

The flow rate of the main pump 11 is reduced so as the drive speeds of the work actuators 4*d* and 4*f* to remain below fixed rates by controlling the pump displacement angle and the engine rotation speed to be smaller values compared with those for traveling as described above. The pump maximum displacement angle and the target rotation speed do not change so as to be maintained at the current values when the motor rotation speed is in the dead zone. In this manner, hunting can be prevented when the motor rotation speed changes to the high speed from the low speed or when it changes to the low speed from the high speed.

When working with the vehicle being stopped, the selection unit 39 selects the displacement angle qp2 and the selection units 50 and 51 each select the target rotation speed Nt2 as the rotation speed command value Nin. As a result, the pump maximum displacement angle is regulated to the value qp2 and the engine rotation speed is adjusted to the value Nt2 so as to reduce the pump flow rate. It is to be noted that the engine rotation speed may be controlled in response to the operation of the fuel lever instead of the pedal operation.

The hydraulic circuit of the wheeled hydraulic excavator explained above can be adopted to a crawler mounted hydraulic excavator as follows.

Figure 10:
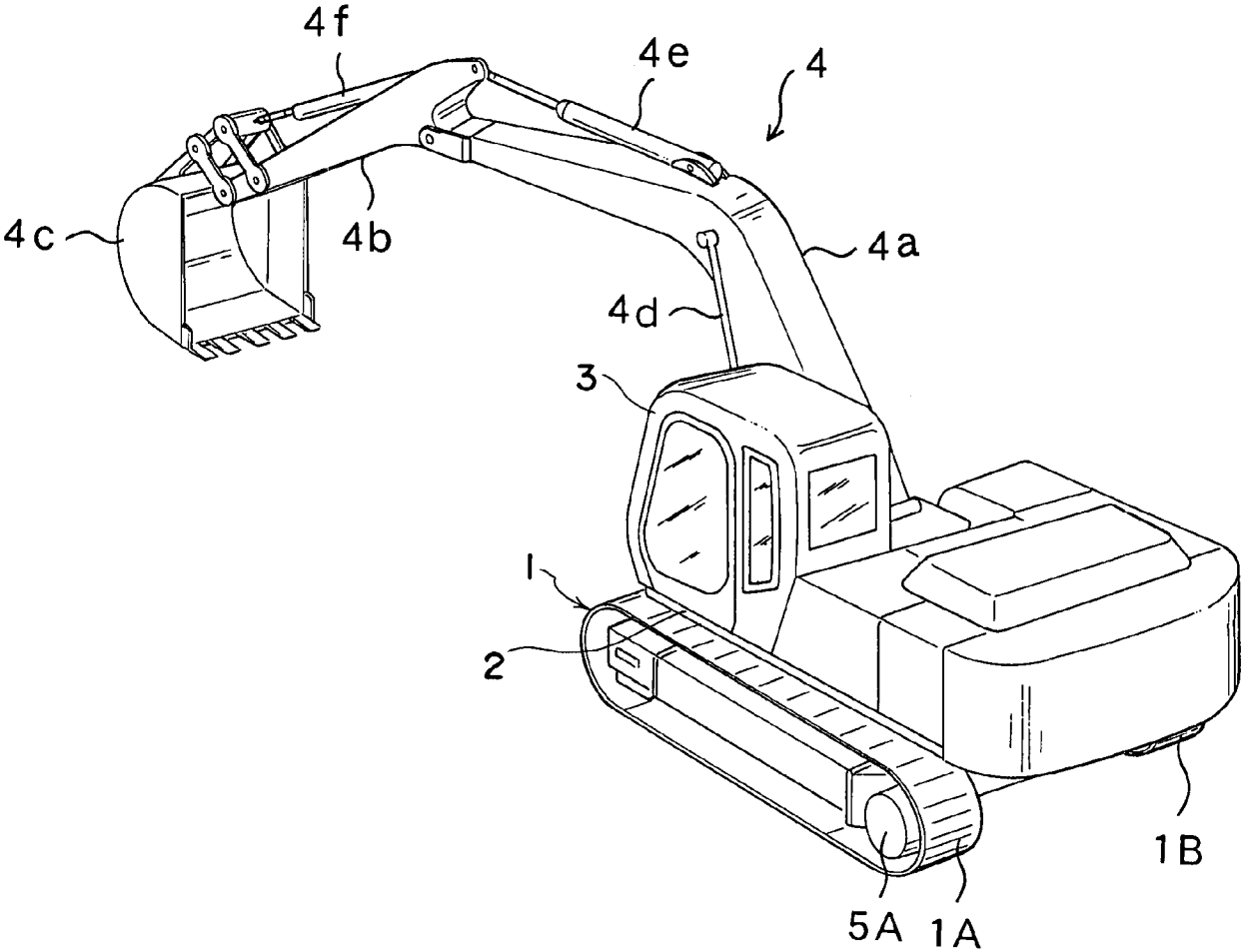
FIG. 10 is an external view of a crawler mounted hydraulic excavator in which the present invention may be adopted.

The crawler mounted hydraulic excavator includes a pair of crawlers 1A and 1B as shown in FIG. 10, and each crawler 1A and 1B is driven respectively by traveling motors 5A and 5B. The front attachment 4 similar to that shown in FIG. 1 is mounted at the front of the revolving superstructure 2.

Figure 11:
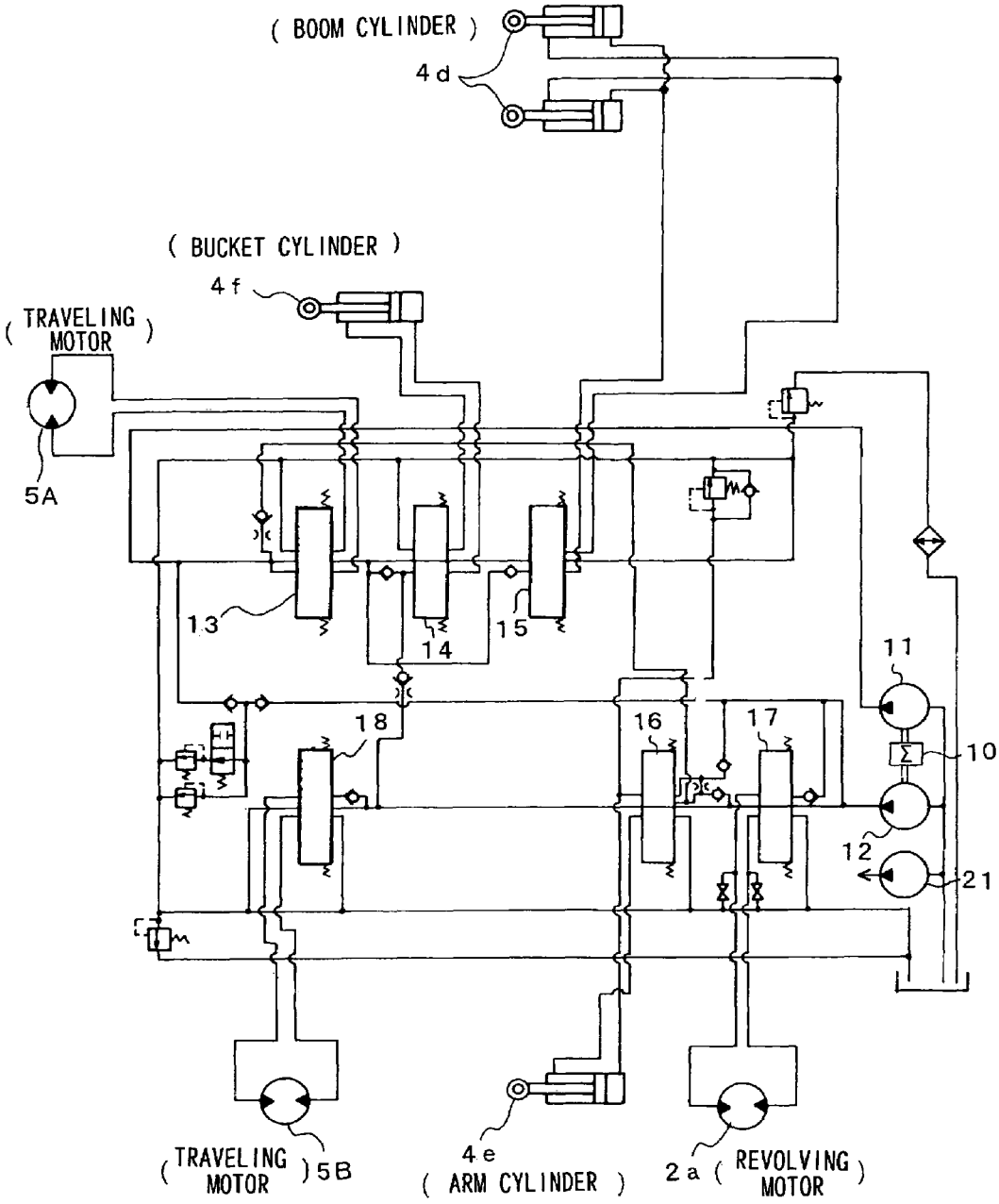
FIG. 11 is a circuit diagram of a hydraulic circuit in the crawler mounted hydraulic excavator in FIG. 10.

A hydraulic circuit for driving actuators installed in the crawler mounted hydraulic excavator is shown in FIG. 11. It is to be noted that the same reference numerals are assigned to elements identical to that shown in FIG. 2. As shown in FIG. 11, one traveling motor 5A is connected with the control valve 13 and the other traveling motor 5B is connected with the spare control valve 18. The oil delivered from the main pumps 11 and 12 is supplied respectively to the traveling motor 5A and 5B via the control valves 13 and 18 so as to drive each of the traveling motors 5A and 5B. As a result, each crawler 1A and 1B can be independently driven. In this case, neither maximum displacement angle nor the engine rotation speed of main pump 11 is increased and the maximum flow rate of the pump 11 is adjusted to the value normally set.

According to the embodiment, the following advantages can be achieved.

(1) The maximum displacement angle of the main pump 11 and the engine rotation speed are increased when the wheeled hydraulic excavator is to travel. Accordingly, the pump flow rate increases and it is possible for the vehicle to travel at high-speed only with the pressure oil from the main pump 11 without the confluence circuit being formed. The control valves 13 to 17 are installed so that a single control valve corresponds to one of the actuators, i.e., the boom cylinder 4*d*, the arm cylinder 4*e*, the bucket cylinder 4*f*, the revolving motor 2*a*, or the traveling motor 5 as shown in FIG. 2, and as a result, the control valve sections can be used in an effective manner.

(2) By using the control valve sections effectively, the pressure loss of the hydraulic circuit can be reduced.

Figure 12:
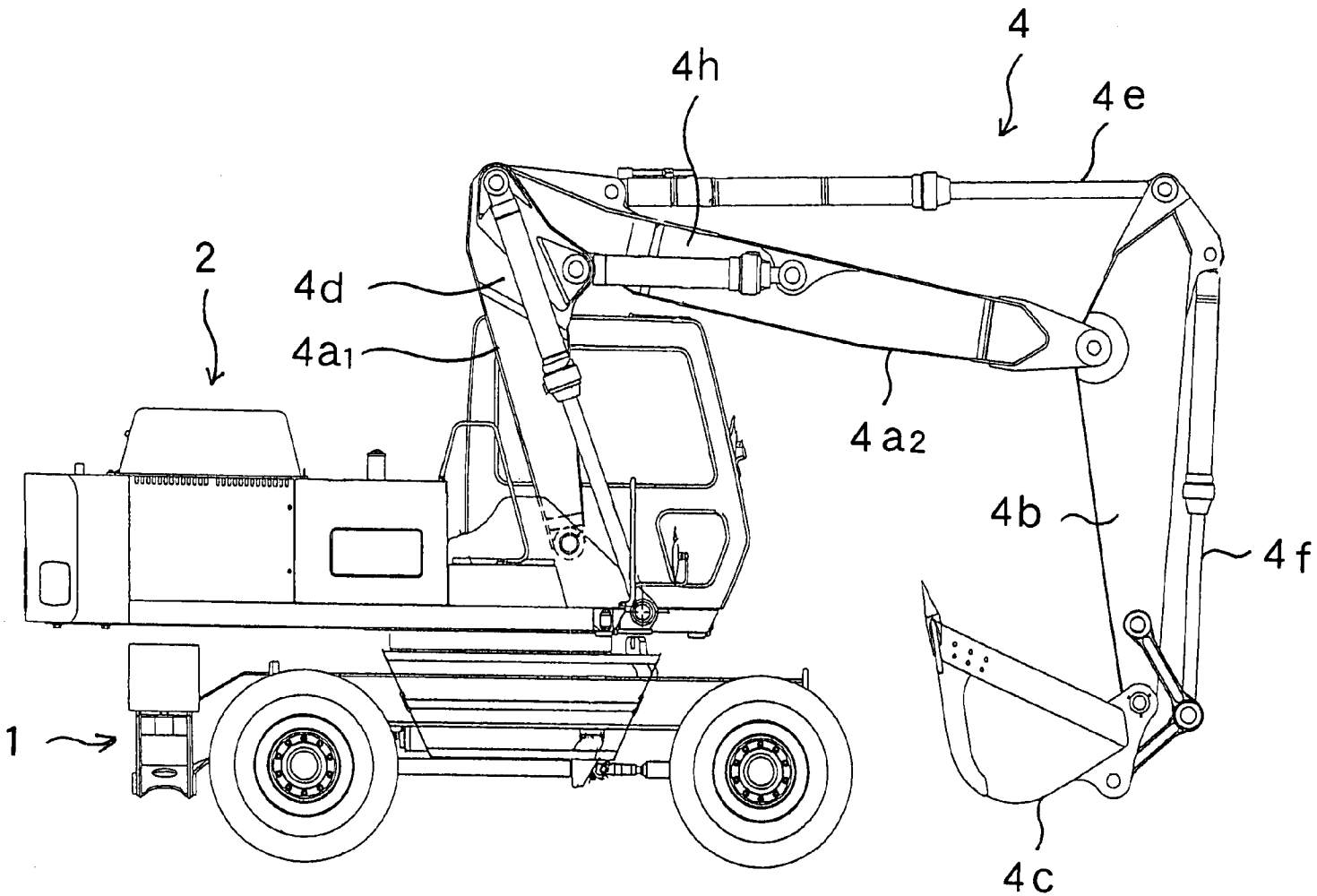
FIG. 12 shows another example of the wheeled hydraulic excavator in which the present invention may be adopted.
Figure 13:
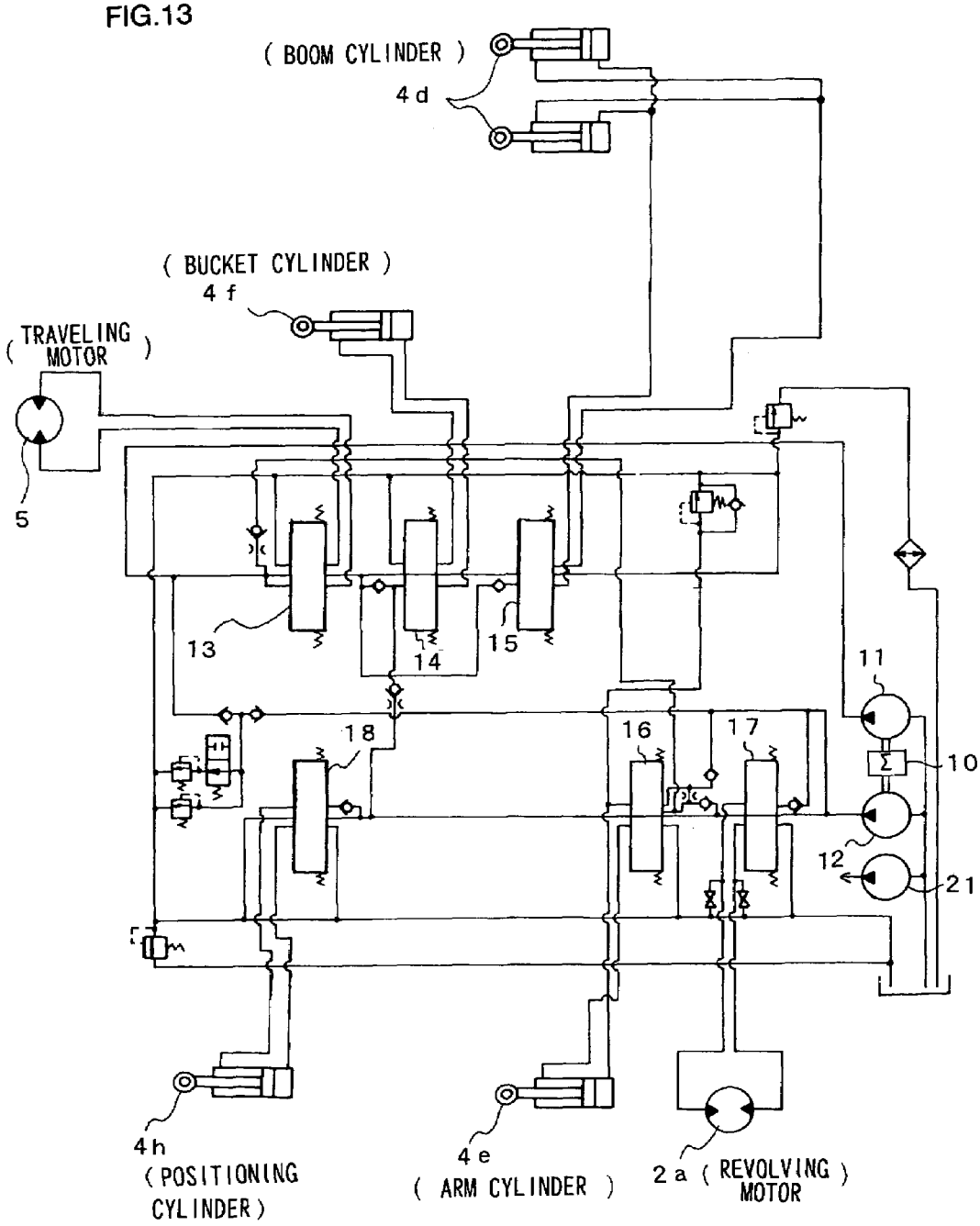
FIG. 13 is a circuit diagram of a work hydraulic circuit in the wheeled hydraulic excavator in FIG. 12.

(3) If the control valve sections of the crawler mounted hydraulic excavator are to be adopted to the wheeled hydraulic excavator, there will be a control valve left. Therefore, another actuator can be installed in the wheeled hydraulic excavator. One example of the wheeled hydraulic excavator in this case is shown in FIG. 12 and its hydraulic circuit is shown in FIG. 13. In the vehicle shown in FIG. 12, the boom 4*a* shown in FIG. 1 is separated into a first boom 4*a*1 and a second boom 4*a*2, and therebetween a positioning cylinder 4*h* that allows the booms to move rotatably relative to each other is provided. The expansion/contraction of the position cylinder 4*h* is controlled in accordance with an operation of the control valve 18.

(4) Since the maximum displacement angle is regulated in two levels, the oil delivered from the pump can be increased easily when traveling.

(5) Since the engine rotation speed is increased when raising the pump maximum displacement angle, the oil delivered from the pump can be increased a great deal when traveling.

(6) The traveling motor 5 is driven with the flow rate of one main pump 11 of the pair of the main pumps 11 and 12 being increased, and thus there is no need to make the maximum displacement angle of the other main pump 12 adjustable so that a conventional pump can be used as the main pump 12.

It is to be noted that while both of the pump maximum displacement angle and the engine rotation speed are adjusted in the above described embodiment, only one of the pump maximum displacement angle and the engine rotation speed may be adjusted. Neither the kind nor the number of actuators used for the wheeled hydraulic excavator and the crawler mounted hydraulic excavator are limited to the above-mentioned embodiment. The drive command for the traveling motor 5 may be detected by using a motor drive pressure instead of the travel pilot pressure. A flow rate control means is constituted with the control circuits 30 and 40, the regulator 11*a*, the pulse motor 43 and the like, however, the pump flow rate can be changed by using other components. While the pressure sensors 24 and 27 are installed in the pilot circuits to detect the travel command and the work command respectively, other detection means, for instance, a pressure switch may be used instead. The operations of the travel pedal 22*a* and the operating lever 25 may also be detected directly with a stroke sensor or micro switch. Work tools other than the bucket 4*c* may be used as the work front attachment 4. For instance, various work tools suited to the particular nature of the work to be undertaken, such as a fork and lifting magnet as a holding tool and loading tool, a crushing device as a crushing tool may be used besides the bucket 4*c* as the excavation tool.

INDUSTRIAL APPLICABILITY

While an explanation is given above on examples in which a wheeled hydraulic excavator or a crawler mounted hydraulic excavator represents an example of a construction machine in which the present invention may be adopted, the present invention may also be adopted in other types of construction machines besides the hydraulic excavator.

The invention claimed is:

1. A construction machine comprising:

a first variable displacement hydraulic pump and a second variable displacement hydraulic pump that are driven by a prime mover;

a single traveling actuator driven with pressure oil discharged from the first variable displacement hydraulic pump;

a plurality of work actuators driven with the pressure oil discharged from at least one of the first variable displacement hydraulic pump and the second variable displacement hydraulic pump;

a plurality of control valves that control flows of the pressure oil from the first variable displacement hydraulic pump and the second variable displacement hydraulic pump to each of the traveling actuator and the plurality of work actuators;

a traveling command detection device that detects a drive command for the traveling actuator;

a work command detection device that detects a work command for an actuator for a work front attachment among the plurality of work actuators; and a flow rate control device that increases a maximum flow rate of the first variable displacement hydraulic pump, wherein the flow rate control device comprises a displacement angle control device that adjusts a maximum displacement angle of the first variable displacement hydraulic pump, and when the drive command for the traveling actuator is detected with the traveling command detection device and the work command is not detected with the work command detection device, the displacement angle control device sets the maximum displacement angle that is larger than the maximum displacement angle set when both the drive command and the work command are detected, and the maximum displacement angle set when the drive command is not detected.

2. A construction machine of claim 1, wherein the construction machine is a wheeled hydraulic excavator.

3. The construction machine of claim 2, wherein the work actuators include the actuator for the work front attachment and a revolving actuator that revolves a revolving superstructure, the actuator for the work front attachment including a boom actuator that drives a boom, an arm actuator that drives an arm, and a work tool actuator that drives a work tool; and the control valves include a traveling control valve that controls a flow of the pressure oil to the traveling actuator, a revolving control valve that controls a flow of the pressure oil to the revolving actuator, a boom control valve that controls a flow of the pressure oil to the boom actuator, and arm control valve that controls a flow of the pressure oil to the arm actuator, and a work tool control valve that controls a flow of the pressure oil to the work tool actuator.

4. The construction machine of claim 3, further comprising a spare control valve.

5. The construction machine of claim 4, further comprising a pair of crawler travel actuators that drive a pair of crawlers respectively, wherein:

the traveling control valve and the spare control valve control flows of the pressure oil to the pair of the crawler travel actuators respectively.

6. The construction machine of claim 1, wherein the flow rate control device further comprises a rotation speed control device that controls a rotation speed of the prime mover, and increases the rotation speed of the prime mover as well as increasing the maximum displacement angle of the first variable displacement hydraulic pump when the drive command for the traveling actuator is detected with the traveling command detection device.

7. The construction machine of claim 6, further comprising:

a travel pedal that is operated to drive the traveling actuator;

a target rotation speed calculation unit for traveling that calculates a first target rotation speed of the prime mover which is set suitable for traveling in accordance with an extent to which the travel pedal is operated; and a target rotation speed calculation unit for working that calculates a second target rotation speed of the prime mover which is set suitable for working in accordance with an extend to which the travel pedal is operated, wherein a maximum value of the first target rotation speed for the traveling is set greater than a maximum value of the second target rotation speed for working.

8. The construction machine of claim 7, wherein the rotation speed control device controls the rotation speed of the prime mover to the second target rotation speed for working when the work command is detected with the work command detection device.

* * * * *

UNITED STATES PATENT AND TRADEMARK OFFICE

CERTIFICATE OF CORRECTION

PATENT NO. : 7,607,245 B2
APPLICATION NO. : 10/528575
DATED : October 27, 2009
INVENTOR(S) : Hidetoshi Satake et al.

It is certified that error appears in the above-identified patent and that said Letters Patent is hereby corrected as shown below:

Title Page, Item (86) PCT No.:

Please change:

(86) PCT No. PCT/JP02/09965

§ 371(c)(1),
(2), (4) Date: "May 22, 2005" to --May 23, 2005--.

Signed and Sealed this

Sixteenth Day of February, 2010

David J. Kappos

David J. Kappos
*Director of the United States Patent and Trademark Office*